US007644912B2

(12) United States Patent
Theilacker

(10) Patent No.: US 7,644,912 B2
(45) Date of Patent: Jan. 12, 2010

(54) APPARATUS AND METHOD FOR LEADING TOGETHER A NUMBER OF PRINTED WEBS

(75) Inventor: Klaus Theilacker, Friedberg (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 352 days.

(21) Appl. No.: 11/516,088

(22) Filed: Sep. 6, 2006

(65) Prior Publication Data

US 2007/0063408 A1 Mar. 22, 2007

(30) Foreign Application Priority Data

Sep. 7, 2005 (DE) ..... 10 2005 042 438

(51) Int. Cl.
*B41L 43/04* (2006.01)
*B65H 20/00* (2006.01)

(52) U.S. Cl. ..... 270/52.07; 270/52.08; 270/5.01; 270/41

(58) Field of Classification Search ..... 270/52.07, 270/52.08, 52.09, 5.01, 41
See application file for complete search history.

(56) References Cited

U.S. PATENT DOCUMENTS

| | | | | |
|---|---|---|---|---|
| 4,417,701 | A | 11/1983 | Moritz | |
| 4,475,730 | A * | 10/1984 | Trogan | 270/41 |
| 4,509,733 | A * | 4/1985 | Pflaum et al. | 270/41 |
| 4,925,170 | A * | 5/1990 | Weis | 270/5.01 |
| 5,535,996 | A * | 7/1996 | Dancause | 270/6 |
| 5,961,758 | A * | 10/1999 | Honegger | 156/73.1 |
| 6,139,003 | A * | 10/2000 | Michalik et al. | 270/52.17 |
| 6,892,635 | B2 * | 5/2005 | Herbert | 101/225 |
| 2004/0244615 | A1 * | 12/2004 | Herbert et al. | 101/227 |

FOREIGN PATENT DOCUMENTS

| | | | |
|---|---|---|---|
| CH | 693 631 | A5 | 11/2003 |
| DE | 31 17 419 | A1 | 4/1982 |
| DE | 198 19 890 | A1 | 11/1999 |
| DE | 101 28 821 | A1 | 1/2003 |
| EP | 1 285 875 | A1 | 2/2003 |
| GB | 2 077 235 | A | 12/1981 |
| JP | 2005096929 | A | 4/2005 |

OTHER PUBLICATIONS

German Search Report w/English translation of Explanations for Section C. Pending Patent Application, titled "Apparatus and Method for Combining a Plurality of Printing Material Webs", Inventor Klaus Theilacker, filed Sep. 6, 2006.

* cited by examiner

*Primary Examiner*—Gene Crawford
*Assistant Examiner*—Leslie A Nicholson, III
(74) *Attorney, Agent, or Firm*—Crowell & Moring LLP

(57) ABSTRACT

An apparatus and method for leading together a number of printed webs is disclosed. Using a device for leading together several printed webs into a multi-layer web sandwich with a harp formed by the deflection rolls assigned to the individual printed webs, the inclusion of air between the webs can be prevented, in that a deflecting web sandwich guide is provided in the exit area of the harp and lies at right-angles to the running direction of the web sandwich.

14 Claims, 1 Drawing Sheet

APPARATUS AND METHOD FOR LEADING TOGETHER A NUMBER OF PRINTED WEBS

This application claims the priority of German Patent Document No. 10 2005 042 438.4, filed Sep. 7, 2005, the disclosure of which is expressly incorporated by reference herein.

BACKGROUND AND SUMMARY OF THE INVENTION

The invention relates to an apparatus and method for leading together several printed webs into a multi-layer web sandwich with a harp formed by the deflection rolls assigned to the individual webs.

As a result of their high speed the printed webs received from the printing machine drag air along with them, as a result of which a laminar stream of air attaches itself to the upper and lower sides of the webs. To the extent that this air is enclosed between the webs as the printed webs come together this results in a swelling of the web sandwich and consequently to a domed web sandwich contour which can lead to inaccuracies as the web sandwich passes over one of the fold formers down-stream of the harp.

For this reason it is, therefore, the object of the present invention to provide a device of the type described above by means of which the inclusion of air between the individual webs can be prevented.

This object is achieved according to the invention by providing in the exit area of the harp a means of deflecting the path of the web sandwich from that of a straight line.

The deflection from the straight line path of the web sandwich leads in an advantageous manner to a very small degree of lapping round the deflection rolls provided in the area of the exit from the harp to produce the desired deflection. As a consequence of this lapping the air which has penetrated between the printed webs is pressed out of them, with the result that the swelling and consequently, the domed web sandwich contour are avoided.

Thus, an S-shaped web sandwich can be expediently provided in the exit area of the harp. Advantageously only two deflection rolls are required which are displaced relative to one another in the running direction of the web sandwich and which slightly overlap each other at right angles to that direction. Nevertheless, the air is reliably expressed from the web sandwich.

In a further development of the superior measures relative to a straight-line web sandwich track the web sandwich deflection rolls can be so arranged expediently that the extent of lapping by the web sandwich amounts to 5 to 15°, preferably 10°. These measures ensure that on the one hand the overlap is sufficient to expel the air reliably from the web sandwich and, on the other hand, with the aid of the friction between the webs, is sufficiently small to avoid speed differences resulting from the overlap. This ensures that there is no loss of tension in the outer webs compared with the inner webs.

A further, particularly preferred development of the superior measures can consist of the fact that the two lowest deflection rolls of the harp are arranged so that relative to one another they are displaced in the running direction of the web sandwich and slightly overlap each other at right angles to that direction. As a result of this there is no need for additional deflection rolls which results in a particularly simple and compact arrangement.

A further advantageous measure can be that the two lowest deflection rolls of the harp are capable of being driven. This makes it possible to pull the outermost web of the packet and thereby increase its tension. The specified measures therefore permit comparatively large lapping angles to be used for expelling the air such that even in difficult operating situations the air is removed in a particularly reliable manner.

Other advantageous developments and expedient developments of the superior measures of the present invention are provided in the following description of an exemplary embodiment as seen in the drawing.

DETAILED DESCRIPTION OF THE DRAWINGS

Figure 1:
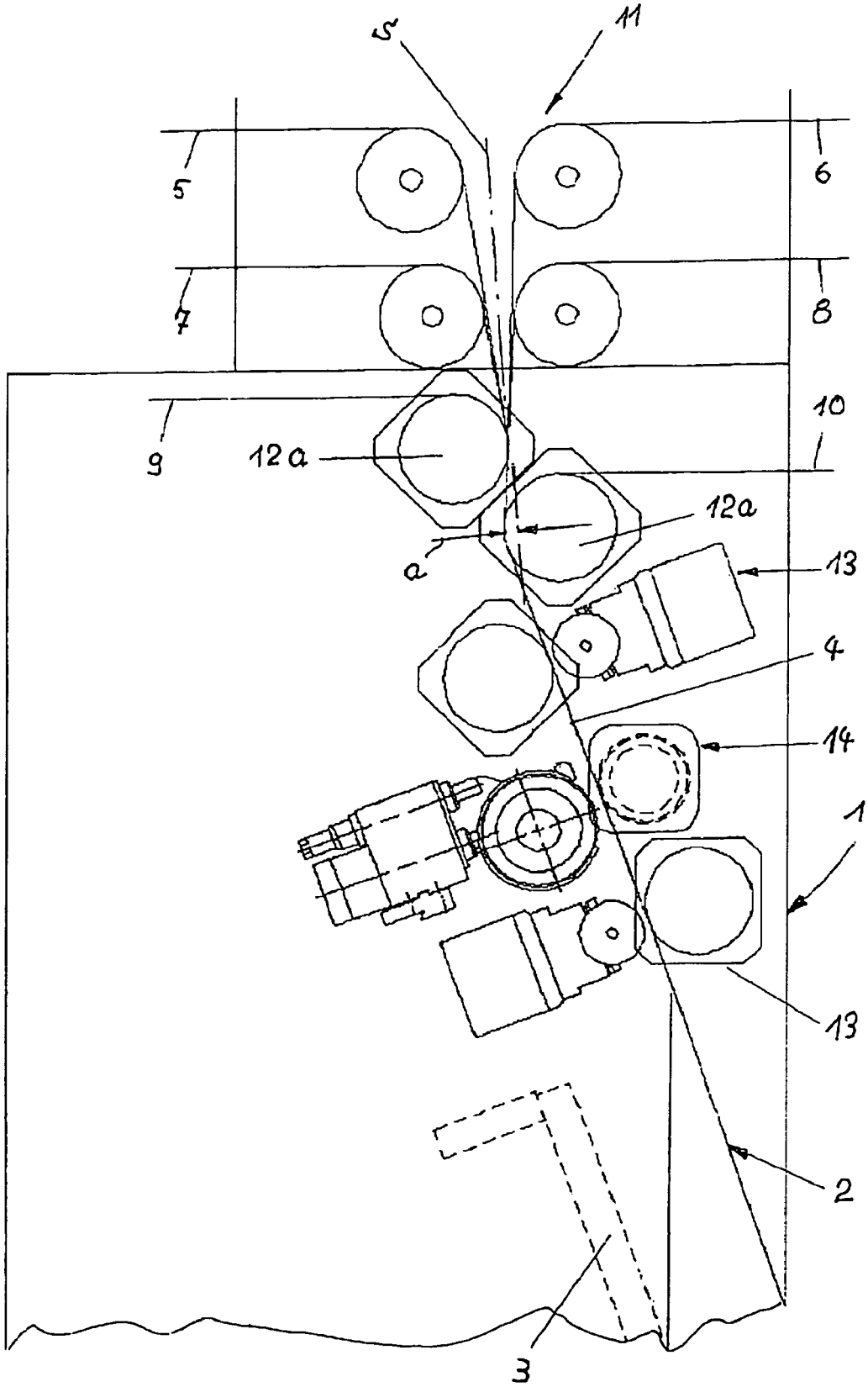
FIG. 1 shows a partial view of the upper part of a folding unit with a fold former and its assigned feed-in device.

FIG. 1 shows the upper area of a folding superstructure 1. Normally a number of fold formers are provided across the width of the folding superstructure 1 of which one fold former 2 can be seen in the drawing. Normally, the fold formers are carried in an adjustable manner by a crossmember 3 which extends across the width of the folding section 1.

A web sandwich 4 consisting of several superimposed webs is led to the fold former 2. These webs can comprise printed webs produced by up-stream printing units. In the illustrated example six printed webs 5 to 10 are led together to form a six-layered web sandwich 4. The lowest web of the web sandwich 4 which is led to the fold former 2 is described as the former web and the remote upper web as the cover web. The webs lying between them are described as intermediate webs.

A so-called harp 11 positioned ahead of the fold former 2 is provided to lead the printed webs 5 to 10 together. This comprises two opposing stacks of deflection rolls which are arranged upon one another and over each of which an assigned printed web 5 or 6 or 7 or 8 or 9 or 10 is deflected downwards. As already mentioned, in the illustrated example a six-layer web sandwich is formed. Correspondingly the harp 11 comprises six deflection rolls.

As a consequence of their high speed, the printed webs 5 to 10 which run into the harp 11 drag the surrounding air with them, with the result that a laminar air stream develops on the upper and lower sides of the webs and it is necessary that when the webs come together this air is pressed out of the web sandwich 4 to avoid undesired inclusions of air between the webs. To achieve this, deflection rolls are provided in the exit area of the harp 11 which are so arranged that in relation to a straight-line web sandwich track shown in the drawing as a dotted line S they deflect the web sandwich 4 at right angles to the running direction of the web sandwich 4. In this way a certain overlapping round the relevant deflection rolls is produced which results in the air being pressed out of the web sandwich 4. In this context, deflection rolls following the harp 11 can be provided. In the illustrated example, the lowest two deflection rolls 12*a* of the harp 11 are used for this purpose which results in a particularly compact arrangement.

Normally two deflection rolls 12*a* provided to form an S-shaped web sandwich track are adequate. It could be conceivable, however, that in order to effect more frequent deflections of the web sandwich, more deflection rolls 12*a* should be provided and employed. In each case, the deflection rolls 12*a* involved in the deflection of the web sandwich with respect to a straight-line web track are slightly offset with respect to one another in the running direction of the web sandwich 4 and they are arranged to mutually overlap slightly at right angles to this direction as shown at reference symbol "a" in the drawing. The dotted line S representing a straight-line web sandwich track meets the upper deflection roll 12*a* tangentially and cuts/intersects the lower deflection roll 12*a* where the distance "a" signifies the vertical distance from the perimeter.

The opposing overlap of the deflection rolls 12*a* forming the S-shaped web sandwich track needs to be relatively small to avoid speed differences developing between the innermost and outermost webs of the web sandwich 4 caused by the overlap. This overlap may only be so small that the friction between the webs is sufficient to suppress speed changes. To that end, the overlapping deflection rolls 12*a* are so arranged that the lapping angle with respect to the web sandwich 4 is no greater than 15° and preferably amounts to 10°. On the other hand this angle must also be not too small if a reliable expulsion of the air is to be achieved. Consequently this overlap angle is not to be less than 5°.

Normally, the fold former web, in this case the printed web 9, and the covering web, in this case the printed web 10, are multi-color printed whereas frequently the intermediate webs are single-color printed. However, multi-printed webs stretch more than single-printed webs, which can lead to a reduction of tension in the fold-former web and cover web, a situation which can further aggravate the abovementioned tendency for speed differences to occur. To counter this, the deflection rolls 12*a* for the fold-former web and cover web can be driven. Correspondingly, in the illustrated example both lower deflection rolls 12*a* in the harp 11 can be driven. In this way it is possible to increase the tension in the fold-former web and cover web as required.

The deflection rolls 12*a* which are capable of being driven are lapped by the relevant assigned printed web 9 or 10 at an angle of at least 60° and, preferably, of 90°.

The deflection rolls 12*a* which are capable of being driven can be provided with assigned single-drive motors. Advantageously, the deflection rolls 12*a* capable of being driven can be connected by a belt drive, which is not depicted, to a common drive motor or, in a particularly preferred manner, to the adjacent aggregates which are also capable of being driven by a common drive motor. In the illustrated example, between the exit area of the harp 11 and the fold former 2, two pull-through units 13 are provided and between these is located a cutting group 14. These aggregates, too, are capable of being driven. Where required, the deflection rolls 12*a* capable of being driven can be connected in terms of drive technology, together with the pull groups 13 and the cutting group 14, to a common drive motor by means of a belt drive.

In each case, however, it can be expedient if in terms of peripheral speed relative to that of neighbouring pull groups the drive of the two deflection rolls 12*a* capable of being driven can be changed. In the case of a common drive this can be effected by, for example, suitable gearing.

LIST OF REFERENCE NUMERALS

1 Folding superstructure
2 Fold former
3 Crossmember
4 Web sandwich
5-10 Printed webs
11 Harp
12*a* Deflection rolls
13 Pull groups
14 Cutting group The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for leading together several printed webs into a multi-layer web sandwich with a harp formed by deflection rolls assigned to the individual printed webs, wherein a two lowest deflection rolls of the harp are drivable, wherein the driveable two lowest deflection rolls of the harp are each overlapped by a respective single web of the several printed webs and wherein the harp is positioned ahead of a fold former, wherein a deflecting web sandwich guide is provided in an exit area of the harp and is formed by the two lowest deflection rolls of the harp, and wherein the deflecting web sandwich guide guides a path of the multi-layer web sandwich in a deviation from a straight-line running direction of the web sandwich.

2. The apparatus according to claim 1, wherein an S-shaped web sandwich guide is provided in the exit area of the harp.

3. The apparatus according to claim 1, wherein the two lowest deflecting rolls are slightly and mutually overlapping.

4. The apparatus according to claim 3, wherein the mutually overlapping deflection rolls are so arranged that an extent of lapping by the web sandwich amounts to 5 to 15°.

5. The apparatus according to claim 4, wherein the mutually overlapping deflection rolls are so arranged that the extent of lapping by the web sandwich amounts to 10°.

6. The apparatus according to claim 1, wherein the driveable two lowest deflection rolls of the harp are overlapped by the respective single web of the several printed webs at an angle of at least 60°.

7. The apparatus according to claim 6, wherein the driveable two lowest deflection rolls of the harp are overlapped by the respective single web of the several printed webs at an angle of 90°.

8. An apparatus for leading together a plurality of printed webs into a multi-layer web sandwich, comprising:

a harp formed by deflection rolls, wherein a two lowest deflection rolls of the harp are drivable, wherein the driveable two lowest deflection rolls of the harp are each overlapped by a respective single web of the plurality of printed webs and wherein the harp is positioned ahead of a fold former; and a deflecting web sandwich guide provided in an exit area of the harp, wherein the deflecting web sandwich guide is formed by the two lowest deflection rolls of the harp and guides a path of the multi-layer web sandwich in a deviation from a straight-line running direction of the web sandwich.

9. The apparatus according to claim 8, wherein the deflecting web sandwich guide is S-shaped.

10. The apparatus according to claim 8, wherein the two lowest deflection rolls are displaced relative to one another in the straight-line running direction of the web sandwich and overlap each other at a right angle to the straight-line running direction.

11. The apparatus according to claim 8, wherein the deviation is between 5 and 15°.

12. A method for leading together a plurality of printed webs into a multi-layer web sandwich, comprising the steps of:

leading together the plurality of printed webs into the multi-layer web sandwich by a harp formed by deflection rolls, wherein a two lowest deflection rolls of the harp are drivable, wherein the driveable two lowest deflection rolls of the harp are each overlapped by a respective single web of the plurality of printed webs and wherein the harp is positioned ahead of a fold former; and guiding a path of the multi-layer web sandwich in a deviation from a straight-line running direction of the web sandwich by a deflecting web sandwich guide provided in an exit area of the harp, wherein the deflecting web sandwich guide is formed by the two lowest deflection rolls of the harp.

13. The method according to claim 12, wherein the two lowest deflection rolls are displaced relative to one another in the straight-line running direction of the web sandwich and overlap each other at a right angle to the straight-line running direction.

14. The method according to claim 12, wherein the deviation is between 5 and 15°.

* * * * *